US008669840B2

(12) United States Patent
Urrea et al.

(10) Patent No.: US 8,669,840 B2
(45) Date of Patent: Mar. 11, 2014

(54) FUSE ASSEMBLY

(75) Inventors: Julio Urrea, Chicago, IL (US); Gary M. Bold, Palatine, IL (US)

(73) Assignee: Littelfuse, Inc., Chicago, IL (US)

( * ) Notice: Subject to any disclaimer, the term of this patent is extended or adjusted under 35 U.S.C. 154(b) by 241 days.

(21) Appl. No.: 13/109,831

(22) Filed: May 17, 2011

(65) Prior Publication Data

US 2011/0285496 A1 Nov. 24, 2011

Related U.S. Application Data

(60) Provisional application No. 61/345,840, filed on May 18, 2010, provisional application No. 61/409,837, filed on Nov. 3, 2010.

(51) Int. Cl.

| | |
|---|---|
| ***H01H 85/02*** | (2006.01) |
| ***H01H 85/143*** | (2006.01) |
| ***H01H 85/165*** | (2006.01) |
| ***H01R 13/68*** | (2011.01) |

(52) U.S. Cl.
USPC ..... 337/188; 337/191; 337/227; 439/620.27

(58) Field of Classification Search
USPC ..... 337/188, 191, 227; 439/620.27
See application file for complete search history.

(56) References Cited

U.S. PATENT DOCUMENTS

| | | | | |
|---|---|---|---|---|
| 3,323,021 | A | 5/1967 | Sever | |
| 3,969,695 | A | 7/1976 | Belcher | |
| 5,451,170 | A | 9/1995 | Suffi | |
| 5,805,047 | A * | 9/1998 | De Villeroche et al. | 337/290 |
| 5,854,583 | A * | 12/1998 | Falchetti | 337/290 |
| 6,294,978 | B1 * | 9/2001 | Endo et al. | 337/166 |
| 6,371,791 | B1 * | 4/2002 | Newton, Jr. | 439/383 |
| 6,456,188 | B1 * | 9/2002 | Tsuchiya | 337/235 |
| 6,509,824 | B2 * | 1/2003 | Inaba et al. | 337/295 |
| 6,902,434 | B2 * | 6/2005 | Stack | 439/620.28 |
| 6,932,650 | B1 * | 8/2005 | Freitag | 439/620.26 |
| 6,985,065 | B2 * | 1/2006 | Aguila | 337/235 |
| 7,172,462 | B1 * | 2/2007 | Gronowicz, Jr. | 439/620.26 |
| 7,192,319 | B1 * | 3/2007 | Rahman et al. | 439/766 |
| 7,323,956 | B1 * | 1/2008 | Puskar et al. | 335/6 |
| 7,420,453 | B2 * | 9/2008 | Matsumura et al. | 337/295 |
| 7,429,906 | B2 * | 9/2008 | Korczynski | 335/6 |
| 7,663,466 | B1 * | 2/2010 | Jetton | 337/191 |
| 7,924,137 | B2 * | 4/2011 | Rahman et al. | 337/187 |
| 7,978,046 | B2 * | 7/2011 | Ohashi et al. | 337/186 |
| 7,990,738 | B2 * | 8/2011 | Urrea et al. | 361/833 |
| 2005/0250389 | A1 * | 11/2005 | Johansen et al. | 439/709 |

(Continued)

OTHER PUBLICATIONS

International Search Report, PCT/US2012/054578 dated Nov. 23, 2012.

*Primary Examiner* — Bradley Thomas
(74) *Attorney, Agent, or Firm* — Kacvinsky Daisak Bluni PLLC

(57) ABSTRACT

A circuit protection assembly employs a post arrangement that is easier to manufacture and has a built-in insulating fuse configuration. The circuit protection assembly is disposed between a source of power and a circuit to be protected. The circuit protection assembly includes comprises a mounting block having a bore extending therethrough and a recess cavity on a first surface of the mounting block. A post having a first end is disposed within the recess cavity and a body portion extends through the bore. A fuse having a centrally disposed aperture is configured to receive the body portion of the post. The post has a second end configured to receive a terminal for connection to a circuit to be protected.

14 Claims, 13 Drawing Sheets

(56) References Cited

U.S. PATENT DOCUMENTS

2008/0050981 A1* 2/2008 Pavlovic et al. ..... 439/701
2009/0066469 A1* 3/2009 Rahman et al. ..... 337/158
2011/0148564 A1* 6/2011 Staylor ..... 337/191
2011/0285496 A1 11/2011 Urrea et al.
2012/0064771 A1 3/2012 Urrea et al.

* cited by examiner

FUSE ASSEMBLY

BACKGROUND OF THE INVENTION

1. Field of the Invention

Embodiments of the invention relate to the field of circuit protection devices. More particularly, the present invention relates to a fuse assembly employing a post arrangement that is easier to manufacture and provides a built-in insulating configuration with the fuse.

2. Discussion of Related Art

Fuses are used as circuit protection devices and form an electrical connection between a power source and a component in a circuit to be protected. In particular, a fuse may be configured to protect against damage caused by an overcurrent condition. A fuse is constructed to physically open or interrupt a circuit path and isolate electrical components from damage upon the occurrence of specified overvoltage and/or overcurrent conditions in the circuit.

Electrical systems in vehicles typically include a number of these types of circuit protection devices to protect electrical circuitry, equipment, and components from damage caused by these conditions. For example, power sources (e.g. batteries) in vehicles utilize a fuse fitted over a terminal post to which a ring terminal of an electrical cable is connected. A nut is usually threaded onto the post to keep the ring terminal and fuse in position. When an excess current condition exists, the fuse on the terminal post protects the components connected to the power source from this excess current. Unintended shorting occurs when the ring terminal comes into direct electrical contact with the post rather than through the fuse. To overcome this problem, an insulating nut fitted over the post has been used to isolate the fuse and the ring terminal to prevent current from bypassing the fuse and damaging the protected circuit.

In certain applications, a single source of power may be shared with a plurality of these fuse arrangements to distribute power to multiple circuits. For example, FIG. 1 is a side cross-sectional view of a fuse assembly 10 illustrating a housing or block 20 from which a post 25 extends and on which fuse 30 is mounted. A ring terminal 40 is fitted over post 25. Ring terminal 40 is connected to a power cable 41 to supply power to an electrical circuit to be protected. Ring terminal is configured to make electrical contact with an upper terminal of fuse 30, but is insulated from post 25. In this configuration, power is supplied to a bus bar 45 disposed in block 20 which is connected to a lower terminal of fuse 30. In this manner, fuse 30 connects the bus bar 45 with ring terminal 40 via fuse element 35. When an overcurrent condition occurs, the fuse element 35 opens or otherwise prevents the flow of current from the bus bar 45 to ring terminal 40 thereby protecting the electrical circuit. Post 25 is molded within block 20 which is typically made from plastic. Unfortunately, by molding one end of post 25 into block 20, additional manufacturing steps and associated costs are incurred. Accordingly, there is a need to provide a fuse assembly that includes a post or terminal portion that is easier to manufacture and provides an insulating configuration to prevent unnecessary short circuits.

SUMMARY OF THE INVENTION

Exemplary embodiments of the present invention are directed to a protection device disposed between a source of power and a circuit to be protected. In an exemplary embodiment, a circuit protection assembly comprises a mounting block having a bore extending therethrough and a recess cavity on a first surface of the mounting block. A post having a first end is disposed within the recess cavity and a body portion extends through the bore. A fuse having a centrally disposed aperture is configured to receive the body portion of the post. The post has a second end configured to receive a terminal for connection to a circuit to be protected.

In another exemplary embodiment, a circuit protection assembly comprises a mounting block having an upper surface and a lower surface. A plurality of posts is included where each of the posts extends from the upper surface of the block. A plurality of fuses each defined by a first and second terminals and a fuse element connecting the first and second terminals where each of the first terminals of the fuses having a centrally disposed aperture configured to receive a respective one of the plurality of posts. A bus bar extends along a length of the bottom surface of the mounting block where the bus bar defines the second terminal of each of the fuses. A power connection assembly is located at a first end of the mounting block and is configured to supply power to the bus bar.

DESCRIPTION OF EMBODIMENTS

Figure 1:
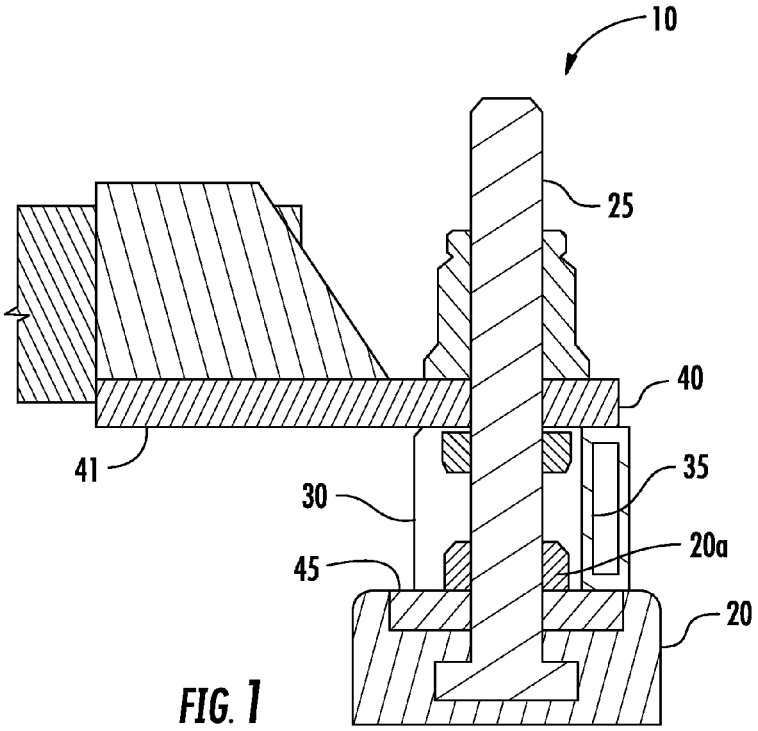
FIG. 1 illustrates a prior art fuse assembly employing a post integrally molded with an block.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Figure 2A:
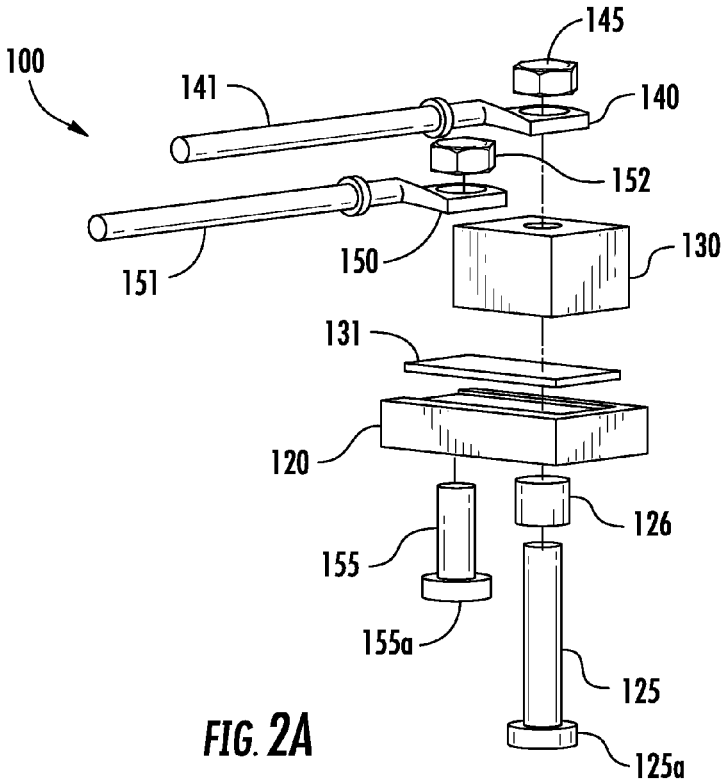
FIG. 2A illustrates an exploded perspective view of an exemplary fuse assembly in accordance with an embodiment of the present disclosure.
Figure 3B:
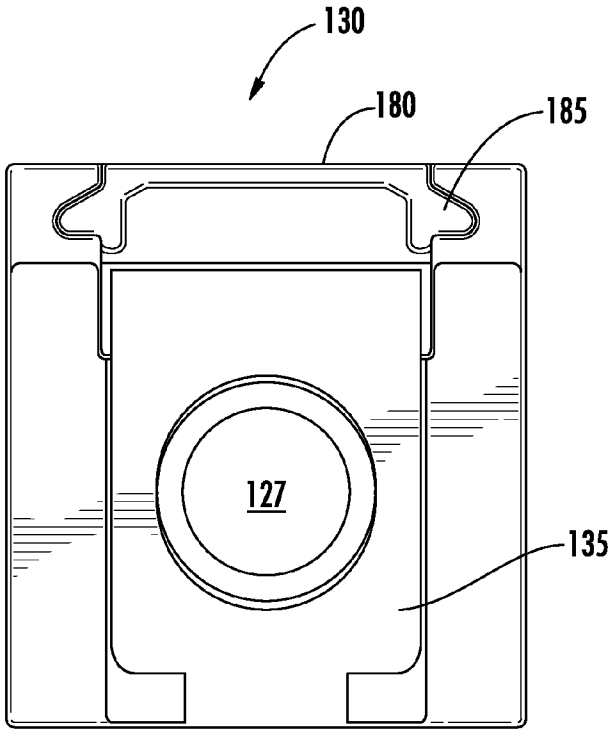
FIG. 3B is a top plan view of a fuse utilized in an assembly in accordance with an embodiment of the present disclosure.

FIG. 2A is a perspective view of a fuse assembly 100 including a housing or block 120 on which one or more fuses 130 are mounted. In this illustration, one fuse 130 is shown with two posts 125 and 155 where post 155 supplies power to a bus plate 131 and post 125 receives fuse 130. In particular, first post 125 is disposed through a receiving bore in block 120 and a corresponding bore in bus plate 131. Fuse 130 may be a ceramic "block" fuse having a generally central aperture (as shown in FIG. 3B) that receives post 125. An insulator 126 isolates post 125 from fuse 130. Ring terminal 140, connected to cable 141, is mounted over post 125 and nut 145 threadedly engages the post to retain both the fuse and the ring terminal in position. A second post 155 extends through block 120 and is in electrical contact with bus bar 131 to provide power thereto. Post 155 is also threaded and receives ring terminal 150 and nut 155. Cable 151 is connected to post 155 via ring terminal 150 to distribute power to the fuse assembly via bus bar 131. In this manner, a circuit is formed from ring terminal 150, to bus plate 131, through fuse 130, to ring terminal 140 to a component and/or circuit to be protected. Thus, power is supplied to the assembly at one location (e.g. ring terminal 150 and bus plate 131) and distributed to circuits through respective fuse assemblies (e.g. fuse 130).

Figure 2B:
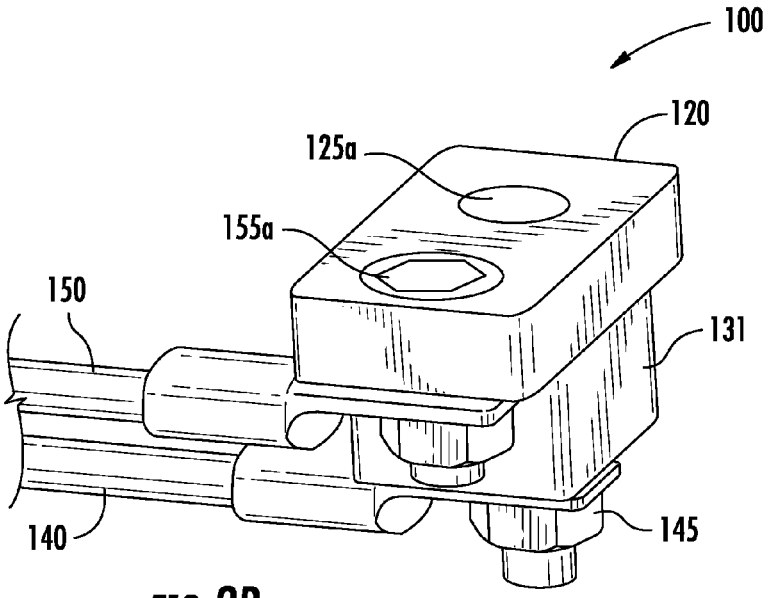
FIG. 2B illustrates a perspective bottom view of the fuse assembly of FIG. 2A in accordance with an embodiment of the present disclosure.

FIG. 2B is a bottom view of assembly 100 illustrating the retaining configuration of posts 125 and 155 within block 120. In particular, the bottom side of block 120 includes recesses sized slightly larger than the heads of each post 125, 155 within which these heads are disposed such that the respective posts are secured in position through block 120. Posts 125 and 155 may be force fit into respective recesses of block 120 where the recesses have the same shape as respective heads of each post 125, 155 with body portions of each of the posts extending through block 120. In this manner, the posts do not need to be integrally molded with block 120, thereby reducing manufacturing and labor costs.

Figure 2C:
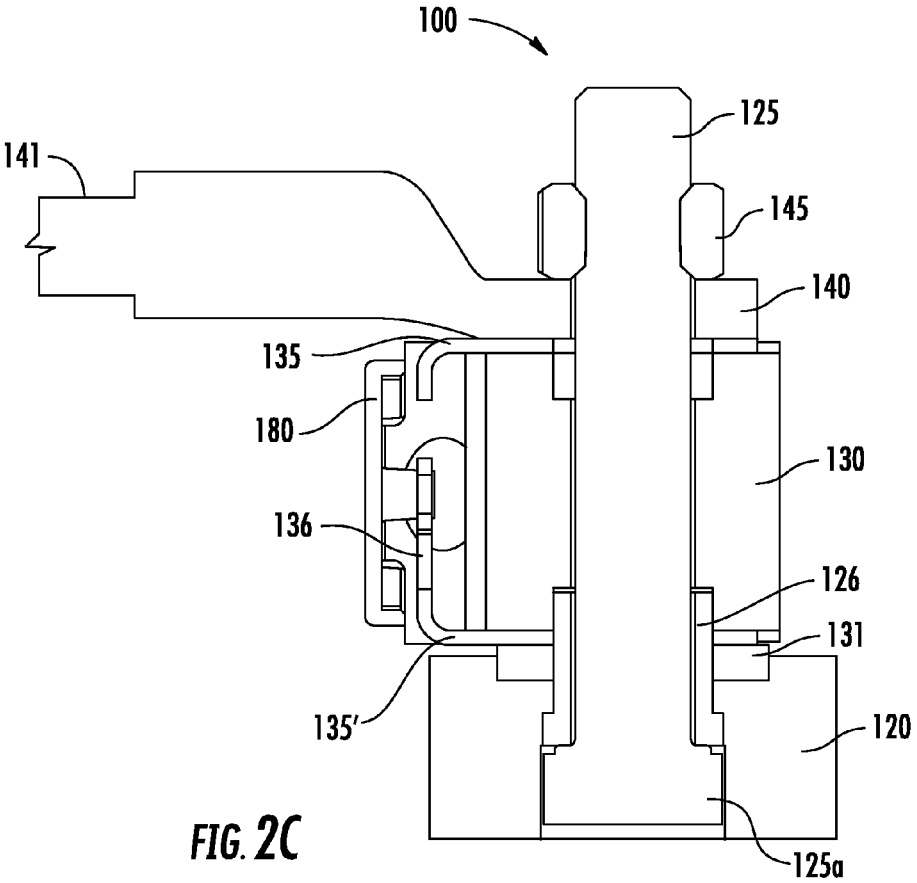
FIG. 2C is a cross-sectional side view of a portion of a fuse assembly shown in FIGS. 2A and 2B.

FIG. 2C is a cross-sectional side view of a portion of a fuse assembly shown in FIGS. 2A and 2B. As can be seen, the head 125*a* of post 125 is recessed within block 120, but not molded therein. Insulator 126, which is a separate component and not molded as part of block 120, extends from the head 125*a* along post 125 into a lower end of fuse 130 to insulate the post 125 from bus bar 131. By not molding post 125 and insulator 126 within block 120, manufacturing costs are conserved. The fusible element 136 is connected to a lower fuse terminal 135' which is in electrical contact with bus bar 131. In normal operating conditions, an electrical connection is formed between bus bar 131, lower fuse terminal 135', fusible element 136, upper fuse terminal 135 and ring terminal 140. When an overcurrent event occurs, fusible element 136 is blown or otherwise breaks this electrical connection.

Figure 3A:
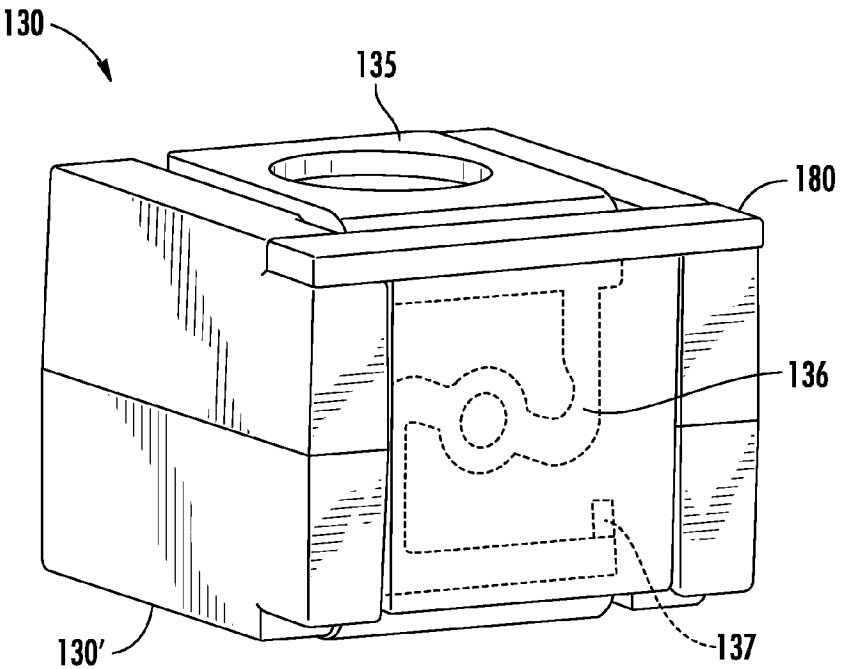
FIG. 3A illustrates an exploded perspective view of a fuse utilized in an assembly in accordance with an embodiment of the present disclosure.

FIG. 3A is a perspective view of a block fuse 130 and FIG. 3B is a top plan view thereof. Fuse 130 is defined by a housing 130' which may be made from, for example, a ceramic material, and has a centrally disposed aperture 127 through which post 125 is received. Fuse 130 includes a fuse element 136 which is in electrical contact with ring terminal 140 via terminal 135 to provide an electrical path to a circuit to be protected for power supplied to bus bar 131. Fuse element 136 may also include a retaining flange 137 which extends toward housing 130' to assist in the retention thereof. Fuse 130 also includes a cover 180 which protects fusible element 136 from ambient particles as well as acting to contain arcing when the fuse is blown due to an overcurrent condition. The cover is at least partially disposed in grooves 185 of fuse body 130' which helps to retain the cover in position.

Figure 4A:
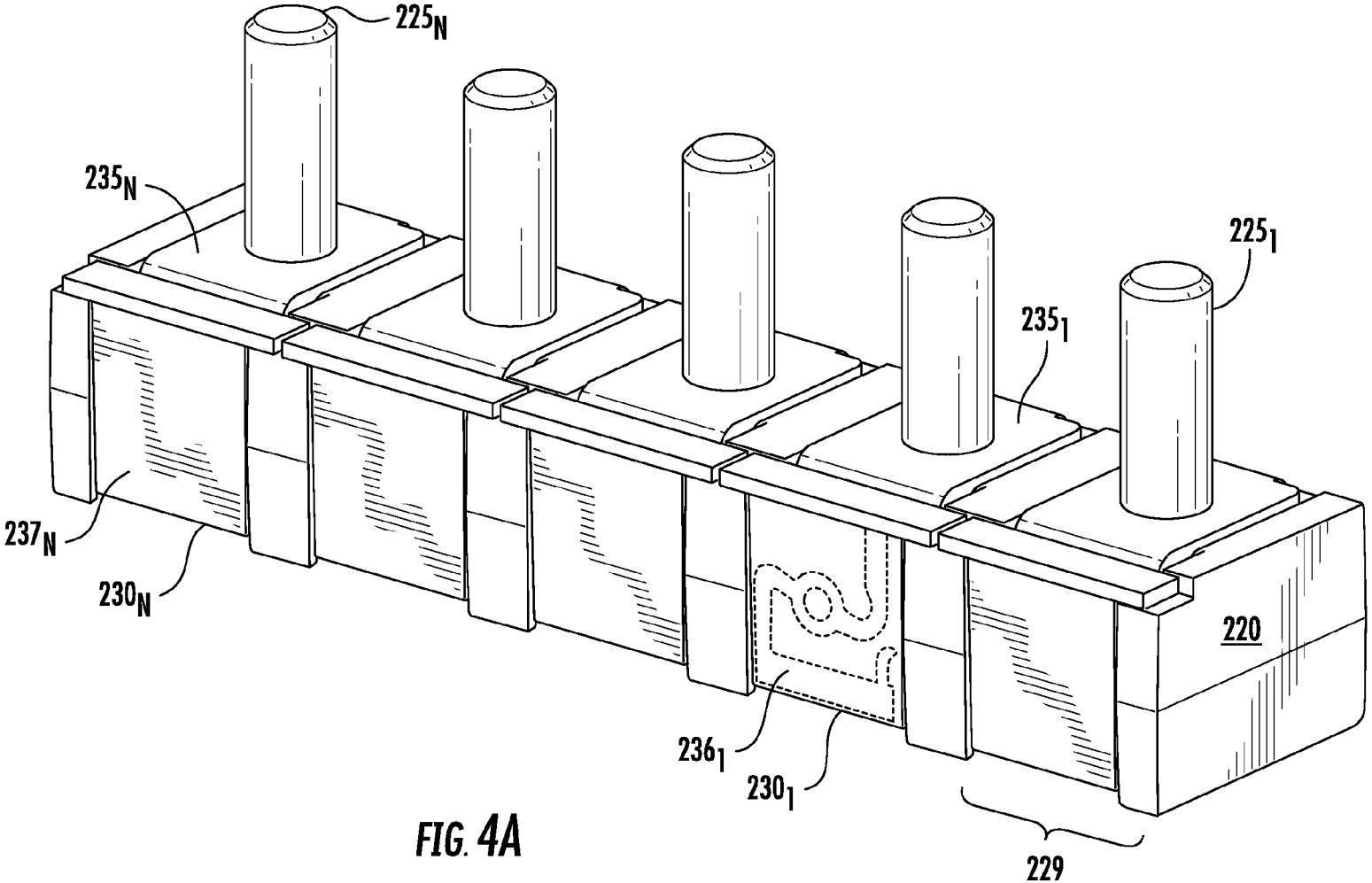
FIGS. 4A-4D are various perspective views of an assembly in accordance with an alternative embodiment of the present disclosure.

FIGS. 4A-4D are various perspective views of an assembly 200 in accordance with an alternative embodiment of the present disclosure. Instead of separate fuses 130 shown in FIGS. 2-3, this embodiment incorporates fuses $230_1 \ldots 230_N$ and block 220 into a unitary assembly. In particular, FIG. 4A illustrates a block 220 including a bus bar 231 disposed on the bottom of the block that extends the length of the block (see FIG. 4D). A first portion 229 of the assembly 200 defines a connection to a power supply when a power supply cable is connected to post $225_1$. The bus bar 231 is connected to post $225_1$ via an electrical connection (not shown) around the outside of block 220. The remaining portions of block 220 define fuses $230_1 \ldots 230_N$ each having separate fuse elements $236_1 \ldots 236_N$ connecting bus bar 231 which acts as a first terminal for each fuse to a second terminal $235_1 \ldots 235_N$. As shown, fuse element $236_1$ is used to electrically connect bus bar 231 to a terminal $235_1$ to define fuse $230_1$. Each of the fuses $230_1 \ldots 230_N$ may also include covers $237_N$ which cover respective fusible elements $236_1 \ldots 236_N$.

Figure 4B:
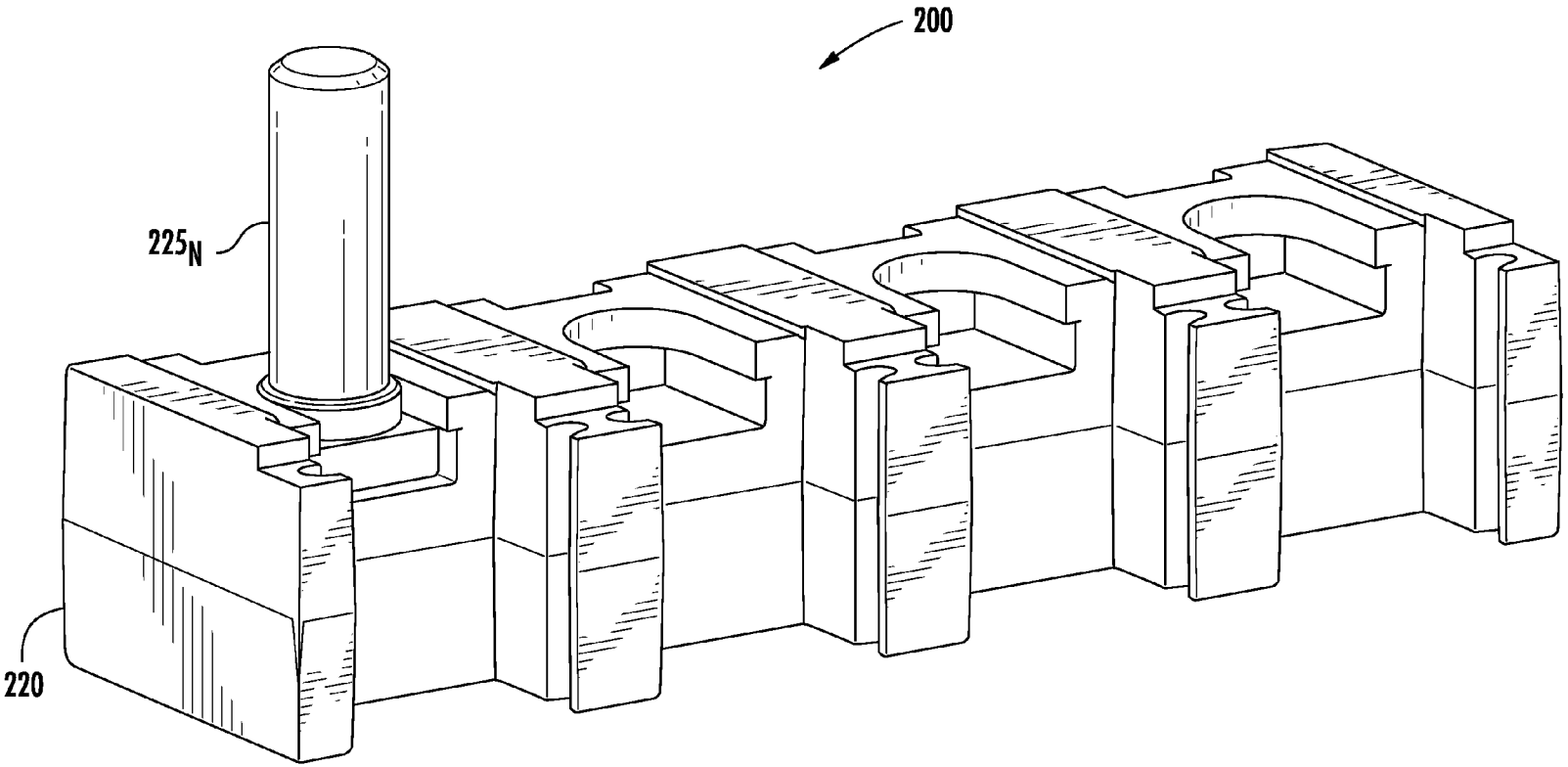

FIG. 4B is used to illustrate just the posts $225_1 \ldots 225_N$ and block 220 without the fusible elements or busbar to show how the posts are positioned within recesses of block 220 for connection to a ring terminal. In particular, block 220 is shown with empty recesses $228_1 \ldots 228_N$ where the fuse elements $231_1 \ldots 236_N$ would be disposed. The head of each post $225_1 \ldots 225_N$ is positioned in block 220. This allows each post to only extend from block 220 through a respective terminal $235_1 \ldots 235_N$ of each fuse. This eliminates the need to insulate each of the posts $225_1 \ldots 225_N$ since each post only protrudes through a corresponding one of the terminals $235_1 \ldots 235_N$ and does not contact bus bar 231. In addition, since no insulator is used, the compression forces that exist once a fuse is mounted on a post $225_1 \ldots 225_N$ are limited to the contact point between the post and the respective fuse terminal. In this manner, each post $225_N$ is in direct contact with a respective terminal $235_N$ of a corresponding fuse $230_N$. This eliminates the need for an insulator to be used which can withstand the compression force of a bolt down joint since all the compression force is directly between the fuse terminal and a respective post. In previous designs, specialty plastics were needed to form the insulators as well as block 220. These costly specialty plastics were selected to withstand heat during use as well as the compression forces generated when a fuse is bolted to a post. In contrast, since the posts of the present disclosure $225_1 \ldots 225_N$ do not extend through the block 220, this obviates the need for a costly high temperature plastic or ceramic to be used that can withstand these compression forces.

Figure 4C:
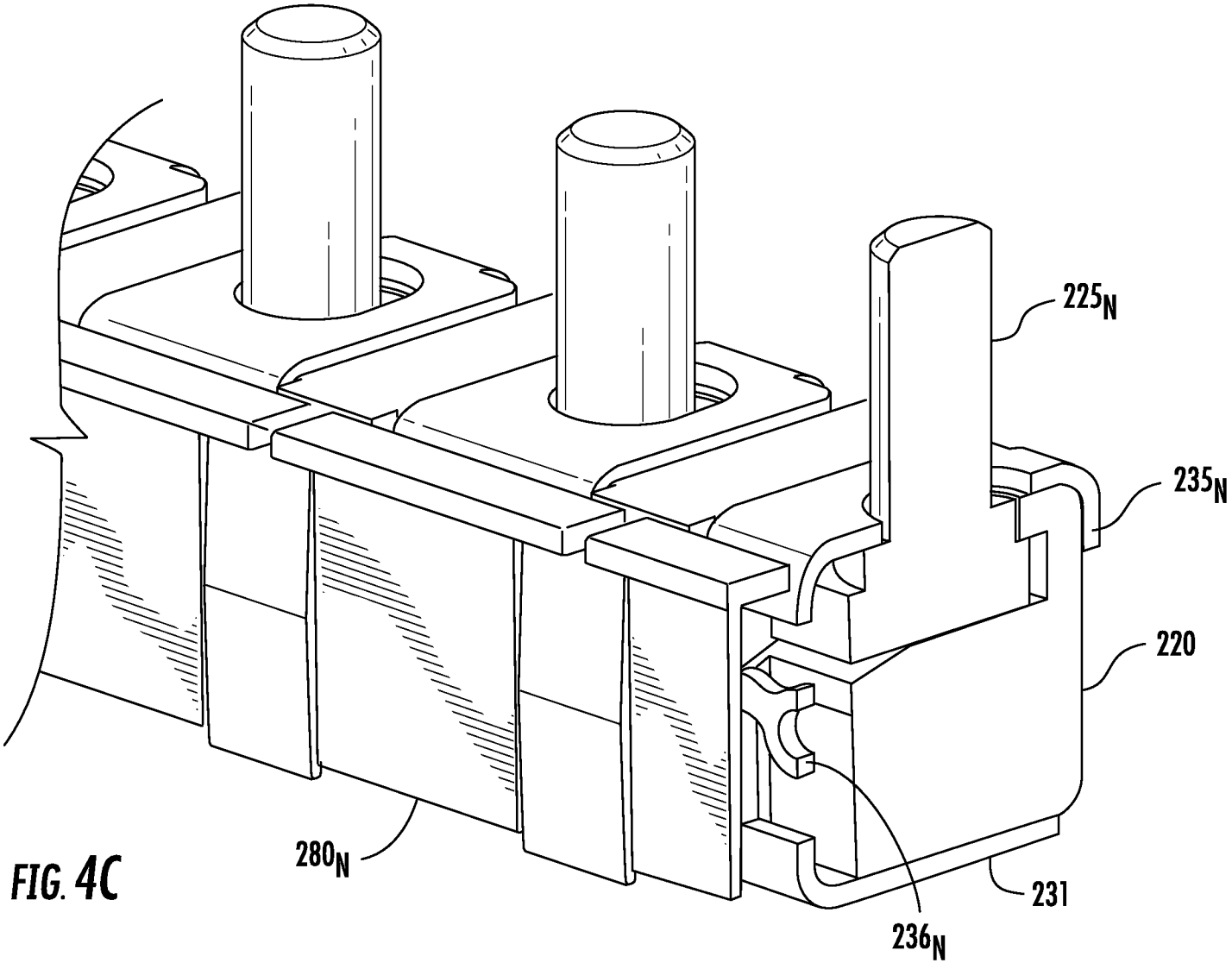
Figure 4D:
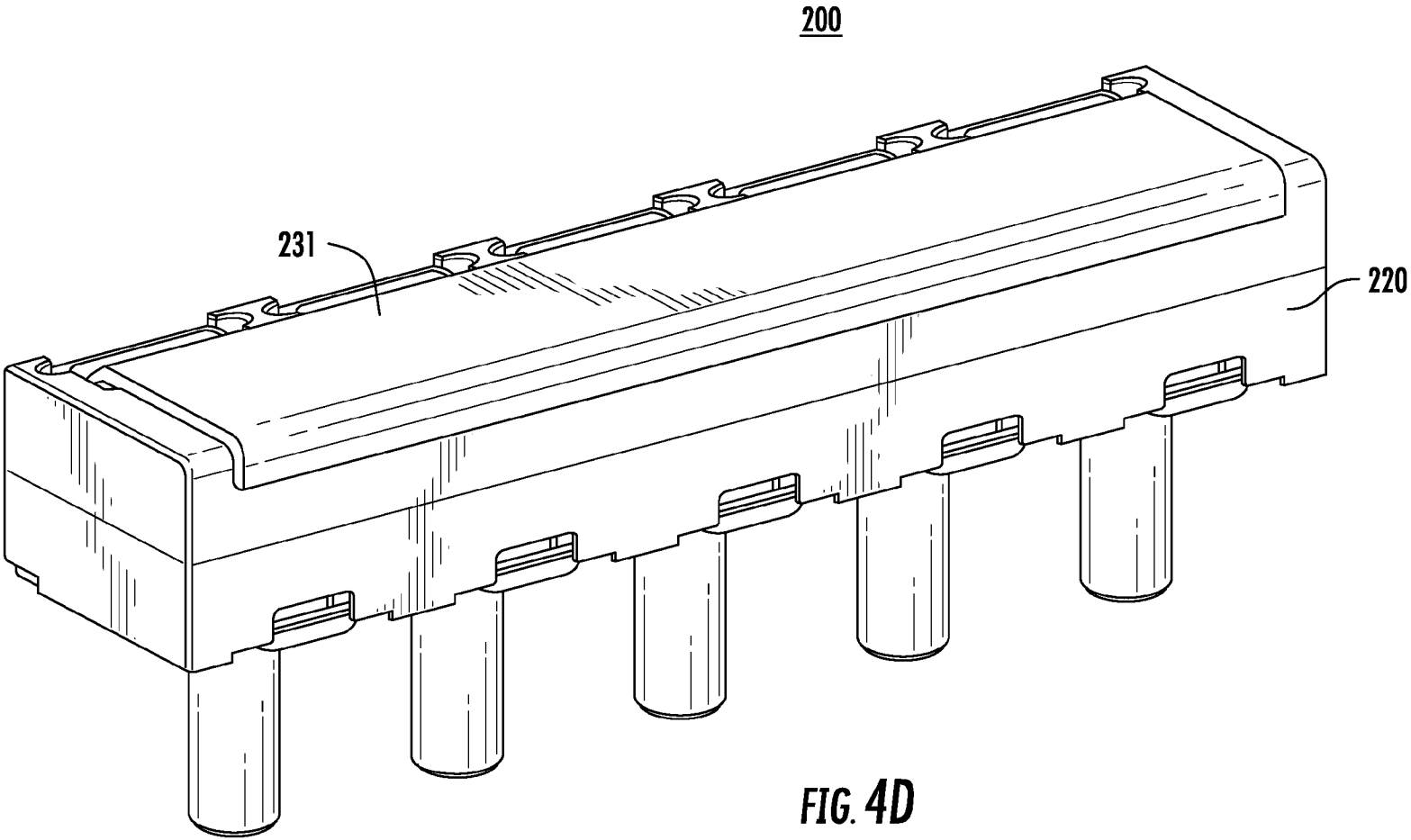

FIG. 4C is a cut-away cross section of the assembly showing a particular fuse $230_N$ having a first terminal defined by a corresponding portion of bus bar 231, second terminal $235_N$ connected by a fuse element $236_N$ and a post $225_N$ that extends upward through an aperture in second terminal $235_N$ for connection to a ring terminal. Each fuse also includes a cover $280_N$ as described in FIG. 3B which protects the respective fusible element $236_N$.

Figure 5:
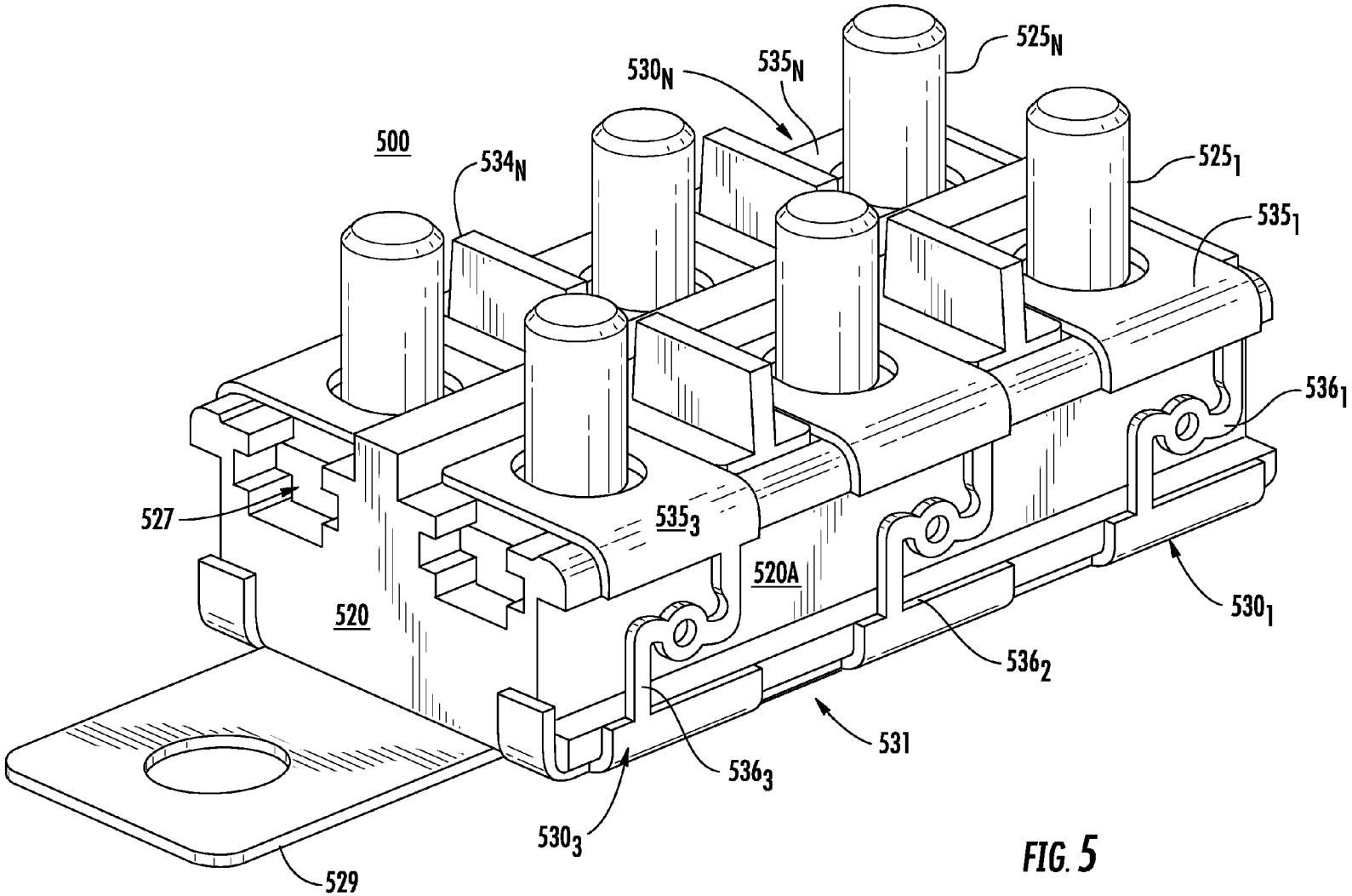
FIG. 5 is a perspective view of an exemplary embodiment in accordance with alternative embodiments of the present disclosure.
Figure 6A:
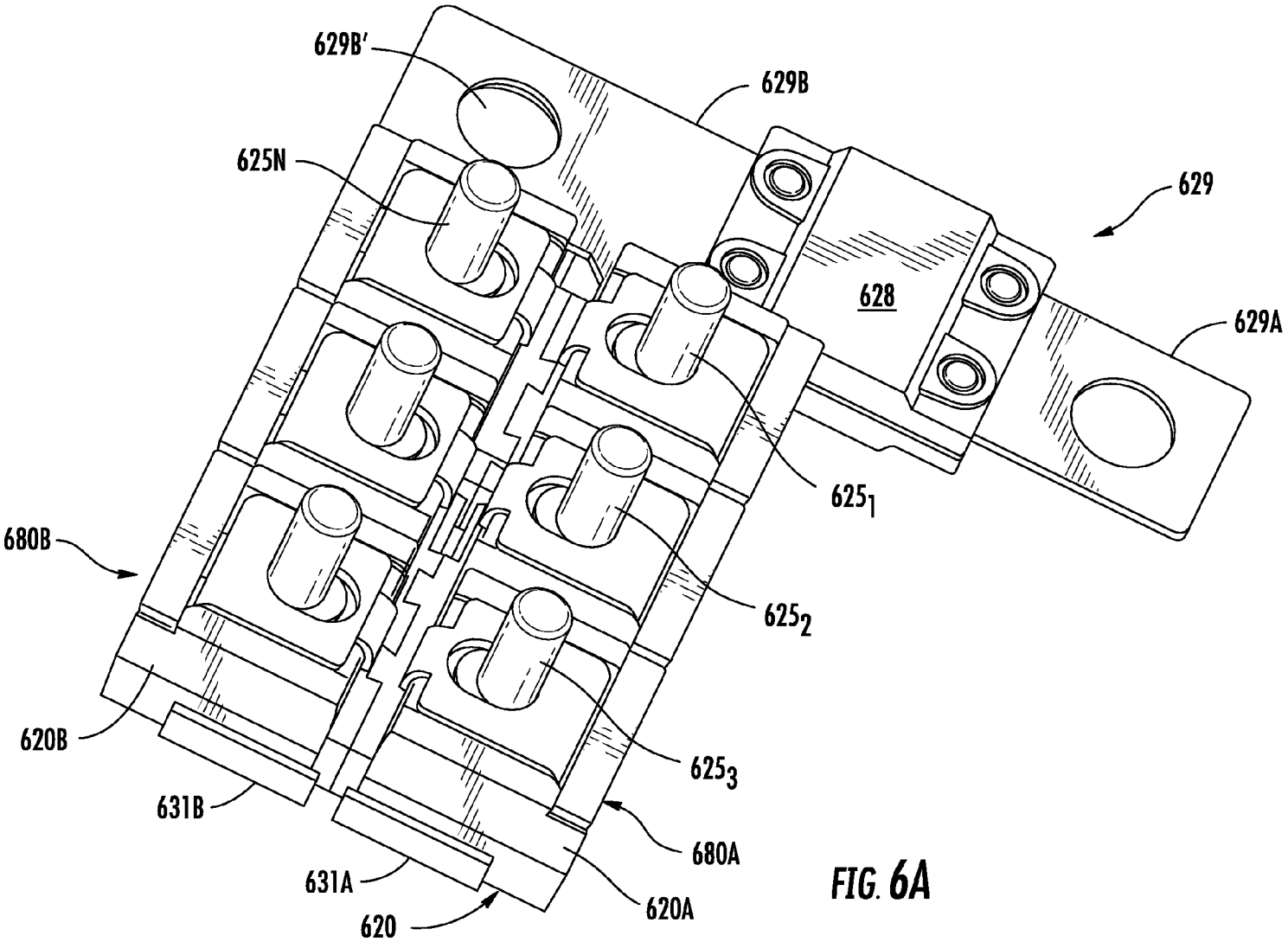
FIGS. 6A-6B are perspective views of an exemplary embodiment in accordance with alternative embodiments of the present disclosure.
Figure 6B:
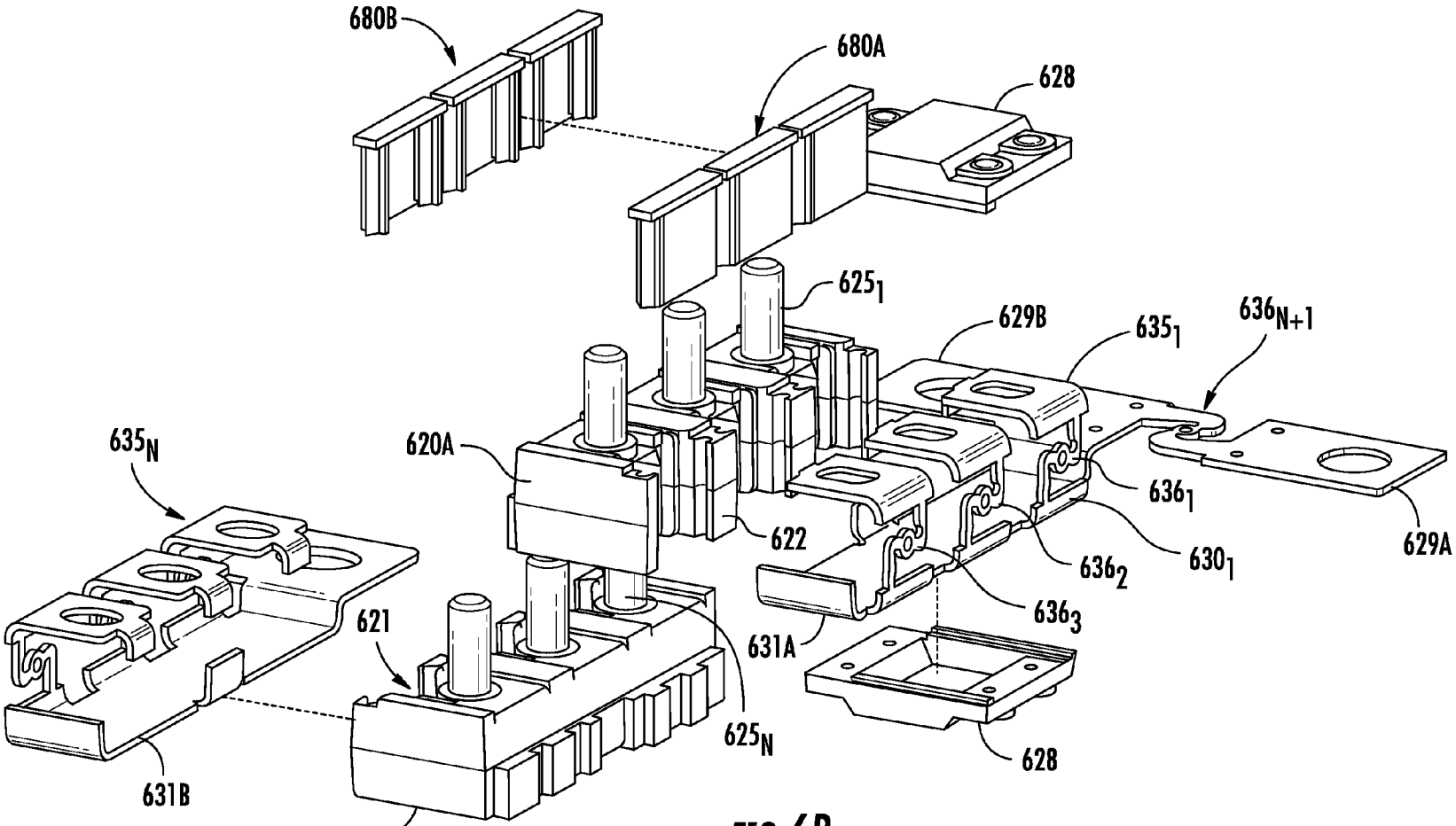
Figure 7:
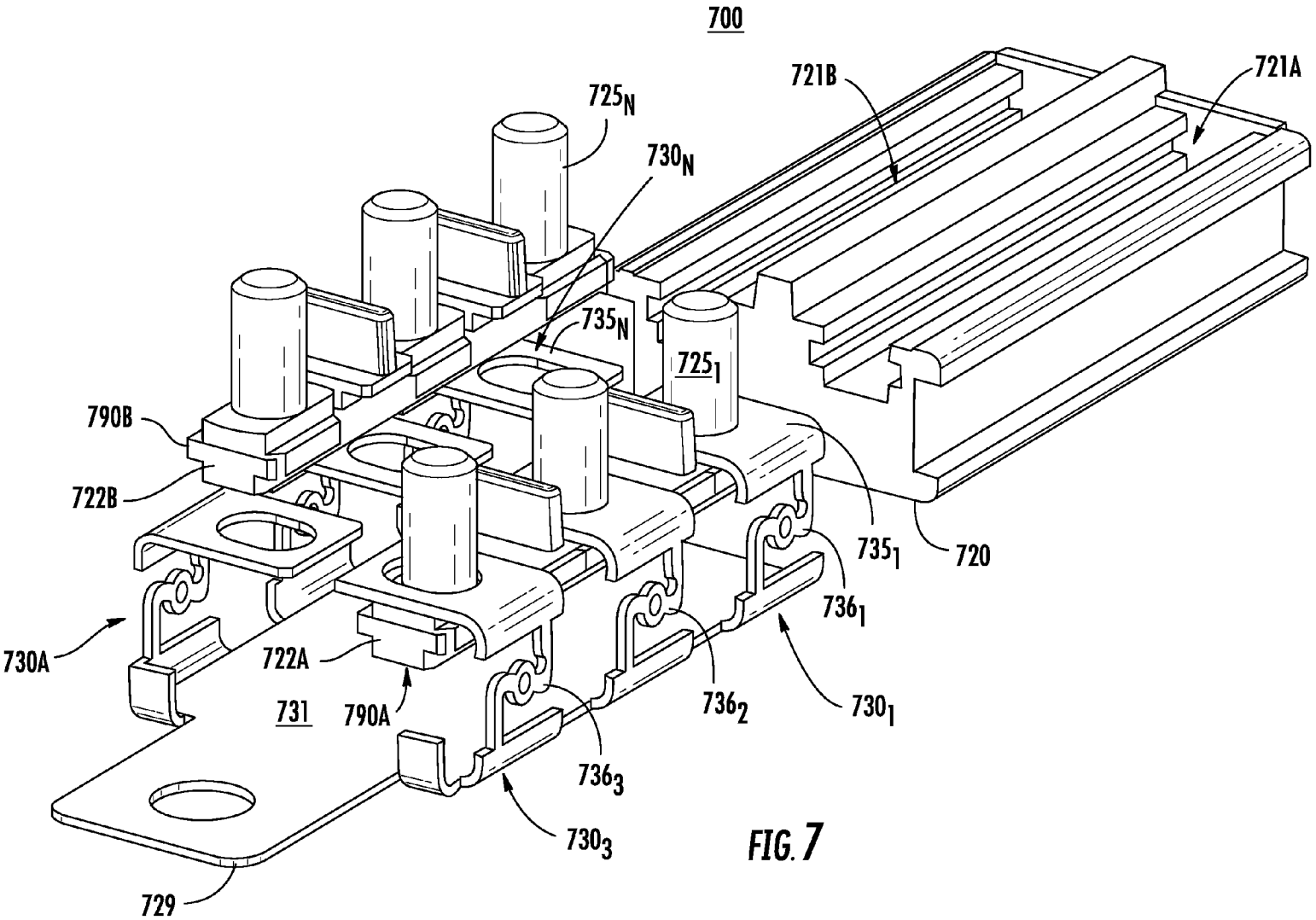
FIG. 7 is an exploded perspective view of an exemplary embodiment in accordance with the present disclosure.

FIGS. 5-7 are various views of assemblies in accordance with alternative embodiments of the present disclosure including different configurations of the terminals, block, posts and fusible elements. FIG. 5 illustrates assembly 500 comprising a block 520 with a pair wise or side-by-side post $525_1 \ldots 525_N$ configuration adapted to receive block fuses (e.g. 130 shown in FIG. 3A). Block 520 may be a unitary piece of, for example, plastic, including a bus bar 531 disposed on the bottom of the block 520 that extends the length and width of the block. A first portion 529 of the bus bar 531 of the assembly 500 defines a connection to a power supply when a power supply cable is connected thereto.

Fuses $530_1 \ldots 530_N$ each have separate fuse elements $536_1 \ldots 536_N$ connecting bus bar 531 which acts as a first terminal for each fuse to a corresponding second terminal $535_1 \ldots 535_N$ of the fuse. For example, fuse element $536_1$ is used to connect bus bar 531 to terminal $535_1$ to define fuse $530_1$. Each of the fusible elements is disposed a distance away from wall 520A of block 520 since the temperature of each of the fusible elements increases during use and should not come in contact with the plastic material of block 520.

Each of a plurality of posts $525_1 \ldots 525_N$ is positioned in block 520 via grooved recesses 527. This allows each post to only extend from block 520 through a respective second terminal $535_1 \ldots 535_N$ and does not contact bus bar 531. As stated above with respect to the previous embodiments, since the posts do not extend all the way through the block 520, this obviates the need for a costly high temperature plastic or ceramic to be used for the block capable of withstanding compression forces when terminals are connected to the posts. Spacers or guards $534_N$ may be disposed between each of terminals $535_N$ to separate each of the terminals $535_1 \ldots 535_N$ and post combinations.

FIGS. 6A-6B illustrate another embodiment of an assembly 600 in accordance with the present disclosure. FIG. 6A is a top perspective view of assembly 600 and FIG. 6B is a perspective exploded view of the same assembly 600. Assembly 600 includes a block 620 defined by a first sub-block 620A and a second sub-block 620B. In this embodiment, the bus bar (e.g. 531 shown in FIG. 5) is defined by a first portion 631A positioned on the bottom of first sub-block 620A and a second sub-portion 631B positioned on the bottom of second sub-block 620B. The bus bar portions 620A, 620B define a first terminal of each of the fuses $630_1 \ldots 630_N$ and the second terminal is defined by respective portions $635_1 \ldots 635_N$. Each of the posts $625_1 \ldots 625_N$ is adapted to receive exemplary ring terminals shown, for example, in FIGS. 1 and 2.

A connection portion 629 receives a power supply cable for the assembly 600. The connection portion 629 is defined by a first connection portion 629A adapted to receive, for example, a ring terminal of the power supply cable and a second connection portion 629B via aperture 629B'. An additional fusible element $636_{N+1}$ (shown more clearly in FIG. 6B) may be disposed between first and second connection portions 629A and 629B and disposed within housing 628.

FIG. 6B illustrates an exploded view of assembly 600 in which the fuse portions $630_1 \ldots 630_N$ are shown as a unitary section defined by respective bus bar portions 631A and 631B, fusible elements $636_1 \ldots 636_N$ and terminals $635_1 \ldots 635_N$. These unitary pieces are disposed around respective block portions 620A and 620B with posts $625_1 \ldots 625_N$ protruding through aperture in each of the upper terminals $635_1 \ldots 635_N$. A first cover 680A and a second cover 680B are used to cover respective fusible elements $636_1 \ldots 636_N$. A first side of each of sub-blocks 620A and 620B has recesses 621 and protrusions 622 that are aligned to fit the two sub-blocks together to form block 620.

FIG. 7 is an exploded perspective view of an alternative assembly 700 in accordance with the present disclosure. In this embodiment, block 720 is a unitary piece and is configured to receive a unitary fuse assembly shown generally as 730A. The unitary assembly 730A is defined by bus bar 731 and fuses $730_1 \ldots 730_N$. The bus bar 731 forms the first terminal of each of the fuses and second terminals $735_1 \ldots 735_N$ are electrically connected to the first terminal via fusible elements $736_1 \ldots 736_N$ disposed therebetween, respectively.

Block 720 includes a first and second recesses 721A, 721B which are configured to receive first and second post blocks 722A, 722B of first and second post assembly 790A and 790B (790A is shown positioned within unitary assembly 730A and 790B is shown outside of unitary assembly 730A for ease of illustration). In this manner, a block 720 slides into the unitary assembly and receives the post assemblies 790A and 790B or unitary assembly 730A slides over block 720 with post assemblies 790A and 790B at least partially disposed within recesses 721A and 721B.

Figure 8A:
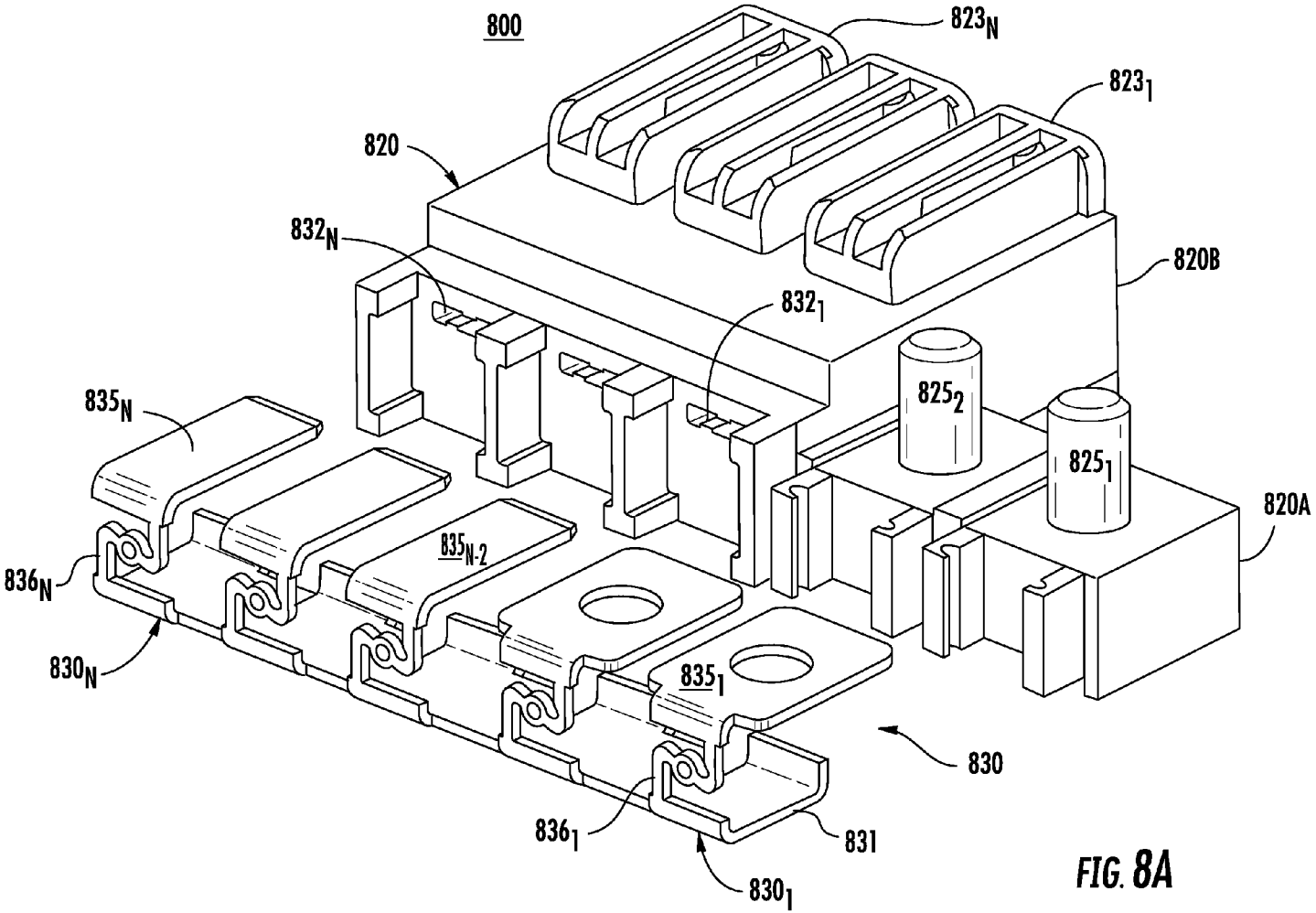
FIG. 8A is a perspective view of an exemplary embodiment in accordance with the present disclosure.
Figure 8B:
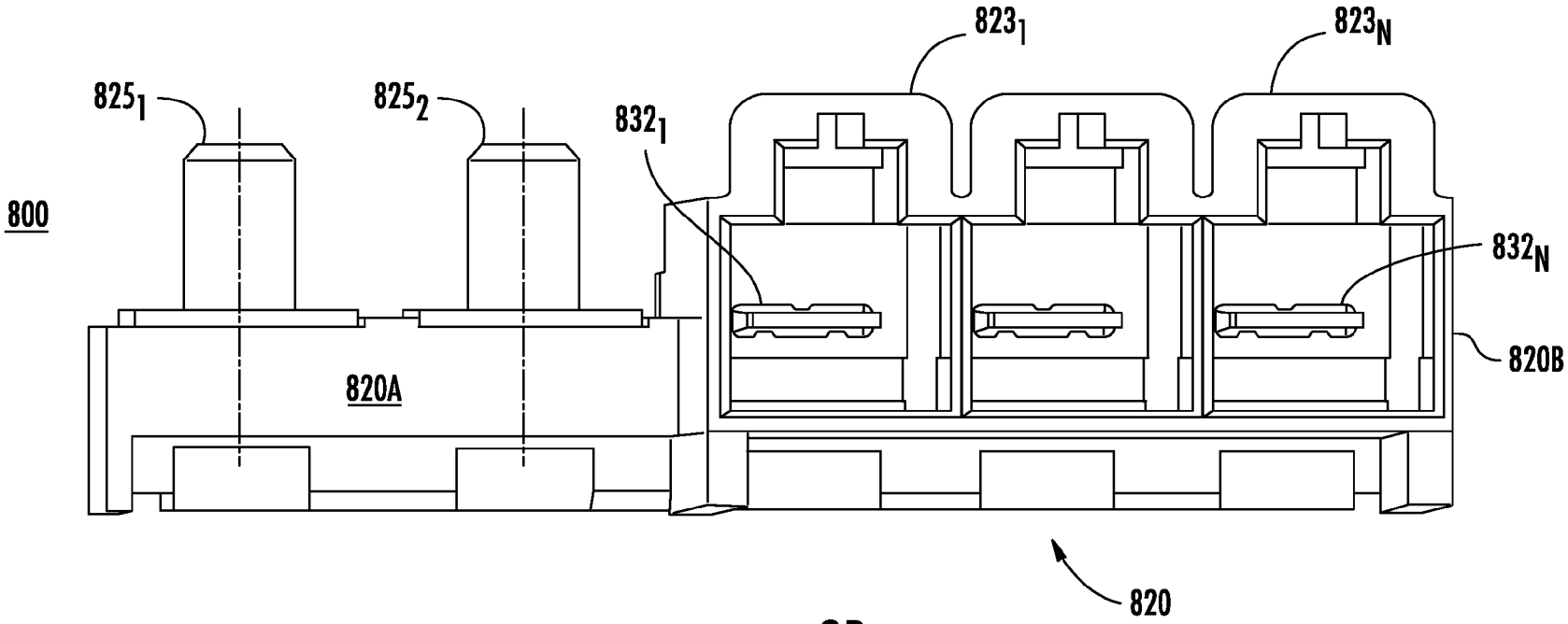
FIG. 8B is a side view of the exemplary embodiment shown in FIG. 8A in accordance with the present disclosure.

FIG. 8A is an exploded perspective view of an alternative embodiment of an assembly 800 in accordance with the present disclosure. In this embodiment, block 820 may be a unitary or multiple piece block with a first portion 820A configured with posts $825_1$, $825_2$ for connection to one or more connection cables and a second portion 820B receiving female fuse portions $835_{N-2} \ldots 835_N$ as described below. A unitary assembly, shown generally as 830A, is defined by bus bar 831 and fuses $830_1 \ldots 830_N$. The bus bar 831 forms the first terminal of each of the fuses and second terminals are illustrated as $835_1 \ldots 835_N$ with fusible elements $836_1 \ldots 836_N$ disposed therebetween, respectively. Terminals $835_{N-2} \ldots 835_N$ may be configured as male terminals for insertion into recesses $832_1 \ldots 832_N$. A plurality of locking portions $823_1 \ldots 823_N$ are disposed on the top of block portion 820B to retain connection to each of the female fuse portions $835_{N-2} \ldots 835_N$. This may be seen more clearly with reference to FIG. 8B which illustrates a side view of assembly 800. The recesses $832_1 \ldots 832_N$ extend through block portion 820B to the other side thereof to receive a connection to the female fuse portions $835_{N-2} \ldots 835_N$ which are retained in place via locking portions $823_1 \ldots 823_N$.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

What is claimed is:

1. A circuit protection assembly comprising:

a mounting block having a bore extending therethrough and a recess cavity on an upper surface of said mounting block;

a post having a first end disposed within said recess cavity and a body portion extending through said bore;

a fuse having an upper fuse terminal, a lower fuse terminal, and a fuse element disposed substantially orthogonal to said upper and lower fuse terminals, said upper fuse terminal having a centrally disposed aperture configured to receive said body portion of said post such that said fuse is disposed partially around said mounting block, said fuse element is retained adjacent to a wall of said mounting block, said wall being disposed substantially orthogonal to said upper surface and a lower surface of said mounting block, and said lower fuse terminal is retained adjacent to said lower surface, said post having a second end configured to receive a terminal for connection to a circuit to be protected; and a bus bar disposed under said lower surface of said mounting block, said bus bar in contact with said lower fuse terminal.

2. The circuit protection assembly of claim 1 further comprising a cover extending from said upper fuse terminal of said fuse to said lower fuse terminal of said fuse wherein said cover is disposed over said fuse element.

3. A circuit protection assembly comprising:

a mounting block having a wall disposed substantially orthogonal to an upper surface and a lower surface;

a plurality of posts each extending from the upper surface of said mounting block;

a plurality of fuses each defined by upper and lower fuse terminals and a fuse element connecting said upper and lower fuse terminals, said fuse element disposed substantially orthogonal to said upper and lower fuse terminals, each of the upper fuse terminals of said fuses having a centrally disposed aperture configured to receive a respective one of said plurality of posts such that said plurality of fuses are disposed partially around said mounting block, said fuse elements are retained adjacent to said wall and said lower fuse terminals are retained adjacent to said lower surface; and a bus bar extending along a length of said lower surface of said mounting block, said bus bar in contact with said lower fuse terminals.

4. The circuit protection assembly of claim 3 wherein said wall has a plurality of recesses in which at least a portion of corresponding fuse elements are disposed.

5. The circuit protection assembly of claim 4 wherein each of said fuse elements are disposed a distance away from said wall to accommodate heat dissipation from each of said fuse elements.

6. The circuit protection assembly of claim 3 wherein said upper surface of said mounting block includes a plurality of recesses, each of said posts having a first end disposed at least partially within said corresponding recesses.

7. The circuit protection assembly of claim 3 further comprising a cover extending from said upper fuse terminal of said fuse said lower fuse terminal of said fuse wherein said cover is disposed over said fuse element.

8. The circuit protection assembly of claim 3 wherein said mounting block includes a recess extending a length of said upper surface of said block, said recess configured to receive a first end of each of said plurality of posts disposed at least partially within said recess.

9. The circuit protection assembly of claim 8 wherein the recess is a grooved recess.

10. The circuit protection assembly of claim 3 further comprising a plurality of guards disposed between each of said plurality of posts on said upper surface of said mounting block.

11. The circuit protection assembly of claim 3 further comprising a power connection assembly located at a first end of said mounting block and configured to supply power to said bus bar.

12. The circuit protection assembly of claim 11 wherein said power connection assembly further comprises a fuse disposed between a power connection portion and said lower terminal of each of said fuses.

13. A circuit protection assembly comprising:

a mounting block having a wall disposed substantially orthogonal to upper and lower surfaces and a recess cavity extending from the upper surface of said mounting block;

a unitary fuse assembly disposed at least partially around said mounting block, said unitary fuse assembly having a plurality of fuses each of which is defined by a portion of a bus plate disposed under the lower surface of said mounting block to form a first terminal of said fuse, a second terminal disposed at least partially on said upper surface of said mounting block and a fuse element disposed substantially orthogonal to and connecting said first terminal and said second terminal;

a post assembly having a body and a plurality of posts extending from said body, said body configured to be slidably inserted at least partially within said recess cavity, wherein said recess cavity is a first recess cavity, said mounting block including a second recess cavity defined within said wall of said mounting block and extending from said upper surface of said block to near said lower surface of said block, said fuse element disposed over said second recess a distance away from said wall of said mounting block.

14. The circuit protection assembly of claim 13 further comprising a power connection portion located at a first end of said mounting block and configured to supply power to said bus plate.

* * * * *